US005510771A

United States Patent [19]

Marshall

[11] Patent Number: 5,510,771

[45] Date of Patent: Apr. 23, 1996

[54] ALARM SYSTEM FOR PRECLUDING A CHILD FROM STRAYING

[76] Inventor: Burpee W. Marshall, 1201-87th St., Niagara Falls, N.Y. 14304

[21] Appl. No.: 179,318

[22] Filed: Jan. 10, 1994

[51] Int. Cl.[6] ..... G08B 23/00

[52] U.S. Cl. ..... 340/573; 340/539

[58] Field of Search ..... 340/573, 574, 340/571, 539

[56] References Cited

U.S. PATENT DOCUMENTS

| | | | |
|---|---|---|---|
| 4,598,272 | 7/1986 | Cox | 340/539 |
| 4,694,284 | 9/1987 | Leveille et al. | 340/574 |
| 4,785,291 | 11/1988 | Hawthorne | 340/573 |
| 4,871,996 | 10/1989 | Tsunamoto et al. | 340/573 X |
| 4,888,580 | 12/1989 | Distel | 340/573 |
| 4,899,135 | 2/1990 | Ghahariiran | 340/573 |
| 5,021,794 | 6/1991 | Lawrence | 340/573 X |
| 5,119,072 | 6/1992 | Hemingway | 340/573 |

FOREIGN PATENT DOCUMENTS

| | | | |
|---|---|---|---|
| 2186723 | 8/1987 | United Kingdom | 340/573 |

*Primary Examiner*—Thomas Mullen

[57] ABSTRACT

A new and improved alarm system for precluding a child from straying for automatically monitoring the presence of a small child within a radius defined by the length of an cable connected between the child and the child's guardian whereby an audible alarm is activated upon disconnecting or cutting of the cable, the cable having an electrical connector at one end removedly operationally connected to an electrical connector of a second wrist strap whereby electrical continuity is formed between the child and the child's guardian when wrist straps are worn and the cable is connected whereby breaking the continuity of the cable activates audible alarm circuitry worn by the child.

4 Claims, 4 Drawing Sheets

ALARM SYSTEM FOR PRECLUDING A CHILD FROM STRAYING

BACKGROUND OF THE INVENTION

1. Field of the Invention

The present invention relates to personal security devices and more particularly pertains to an alarm system for precluding a child from straying which may be used for automatically monitoring the presence of a small child within a radius defined by the length of an cable connected between the child and the child's guardian whereby an audible alarm is activated upon disconnecting or cutting of the cable.

2. Description of the Prior Art

The use of cable activated strayed child alarms is known in the prior art. More specifically, cable activated strayed child alarms heretofore devised and utilized for the purpose of automatically monitoring the presence of a small child are known to consist basically of familiar, expected and obvious structural configurations, notwithstanding the myriad of designs encompassed by the crowded prior art which have been developed for the fulfillment of countless objectives and requirements.

The present invention is directed to improving devices for automatically monitoring the presence of a small child within a radius defined by the length of an cable connected between the child and the child's guardian whereby an audible alarm is activated upon disconnecting or cutting of the cable in a manner which is safe, secure, economical and aesthetically pleasing.

For example, U.S. Pat. No. 5,021,794 to Lawrence discloses a personal emergency locator system consisting of a radio transmitter in a miniaturized transceiver concealed on a person to be located, such as a lost child, is activated and transmits a coded UHF radio homing signal upon receipt of an initiating signal containing the child's address code. The initiating signal is automatically transmitted by a repeater station in response to an audible "panic signal" containing the address code and contains the identical address code. The panic signal is a pulse tone produced by a hand held tone generator activated by the child's parent and is transmitted to the repeater station by telephone. Tracking vehicles are provided with automatic UHF radio direction finding and distance measuring equipment for locating the source of the homing signal. Stored information concerning the child can be transmitted to the tracking vehicle. The invention disclosed operates on a wide area and is unsuitable for instantaneous warning of a strayed child as in a shopping mall or supermarket.

U.S. Pat. No. 4,694,284 to Leveille et al. describes an abduction-preventing collar consisting of two legs pivoted to each other at one end by a hinge member and releasably locked to each other at the other end by a key operated lock. The legs are made of shear-resistant material. A radio signal generating and transmitting device and autonomous power supply are housed within the collar. A trigger switch is closed to activate the device upon opening of a flap by the abducted collar wearer, and circuitry including a silicone controlled rectifier, causes activation if the transmitter and characterized by the impossibility of deactivation thereof, short of complete discharge of the power supply, as long as the lock locks the legs of the collar around the wrist, neck or ankle of the wearer. The invention described makes no provision for warning when the wearer leaves a predescribed control area.

The prior art also discloses a distance monitor especially for child surveillance as shown in U.S. Pat. No. 4,785,291 to Hawthorne and an apparatus for monitoring child activity as described by U.S. Pat. No. 5,119,072 to Hemingway both of which consists of a radio transmitting device affixed to the person to be monitored and separate receiving/monitoring apparatus for providing an indication of the distance from the receiver to the child-born transmitter. Both the inventions disclosed are unreliable because of the unpredictable nature of the radio propagation upon which their operation is based.

U.S. Pat. No. 4,899,135 to Ghahariiran shows a child monitoring device as an ultra-sonic or radio-frequency monitoring system comprising a transmitting unit carried by the child and a receiving unit carried by the child's guardian that will alert the guardian when the child strays beyond a predescribed distance, is abducted or falls into water. The device described has no fail-safe provision for child monitoring in the event the child loses or is relieved of the transmitter unit.

In this respect, the cable activated strayed child alarm according to the present invention substantially departs from the conventional concepts and designs of the prior art, and in so doing provides an apparatus primarily developed for the purpose of automatically monitoring the presence of a small child within a radius defined by the length of an cable connected between the child and the child's guardian whereby an audible alarm is activated upon disconnecting or cutting of the cable.

Therefore, it can be appreciated that there exists a continuing need for new and improved alarm system for precluding a child from straying which can be used for automatically monitoring the presence of a small child within a radius defined by the length of an cable connected between the child and the child's guardian whereby an audible alarm is activated upon disconnecting or cutting of the cable. In this regard, the present invention substantially fulfills this need.

As illustrated by the background art, efforts are continuously being made in an attempt to develop devices for automatically monitoring the presence of a small child within a radius defined by the length of an cable connected between the child and the child's guardian whereby an audible alarm is activated upon disconnecting or cutting of the cable. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of alarm system for precluding a child from straying now present in the prior art, the present invention provides an improved umbilical cable activated strayed child alarm construction wherein the same can be utilized for automatically monitoring the presence of a small child within a radius defined by the length of an cable connected between the child and the child's guardian whereby an audible alarm is activated upon disconnecting or cutting of the cable. As such, the general purpose of the present invention, which will be described subsequently in greater detail, is to provide a new and improved alarm system for precluding a child from straying apparatus and method which has all the advantages of the prior art alarm system for precluding a child from straying and none of the disadvantages.

The invention is defined by the appended claims with the specific embodiment shown in the attached drawings. For the purpose of summarizing the invention, the invention may be incorporated into a new and improved alarm system for precluding a child from straying for automatically monitoring the presence of a small child within a radius defined by the length of an cable connected between the child and the child's guardian. An audible alarm is activated upon disconnecting or cutting of the cable. The cable activated strayed child alarm comprises a multiconductor retractile coil cable having mechanically locking multiple-contact electrical connector means fixedly operationally connected to both ends such as a standard modular telephone handset cable. The strayed child alarm also includes an adult wrist strap for securing the first end of the cable to the child's guardian. The strayed child alarm additionally includes a child wrist strap for securing the second end of the cable to the child. The alarm system for precluding a child from straying further includes a radio frequency transmitter means having a self-contained power source such as a battery. The alarm means comprises processor means circuitry having power supply input terminals, audible signal loudspeaker output terminals, and normally-closed input terminals which are operationally connected to the normally-closed switch contact output terminals of the radio frequency receiver means. Finally, the alarm system for precluding a child from straying includes a multiconductor electrical interconnect cable fixedly operationally extending from the electrical connector means of the child wrist strap to the normally closed terminals of the radio frequency receiver means and processor means thereby completing the closed-loop required by the alarm means for proper operation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved alarm system for precluding a child from straying for automatically monitoring the presence of a small child within a radius defined by the length of an cable connected between the child and the child's guardian whereby an audible alarm is activated upon disconnecting or cutting of the cable, the cable activated strayed child alarm comprising a backpack or waistpack worn by the child, the pack containing electrical alarm circuitry whereby an audible alarm is sounded upon activation; a first elastic wrist strap worn by the child, the first wrist strap having an electrical connector fixedly connected thereto; an electrical interconnect cable fixedly operationally connected to the first wrist strap connector, the cable extending from the first wrist strap to the alarm circuitry inside the pack, the interconnect cable being operationally connected to the alarm circuitry; a second elastic wrist strap worn by the guardian, the second wrist strap having an electrical connector fixedly connected thereto, the electrical connector having it's terminals operationally connected together whereby a short-circuit is formed; a retractile electrical cable having an electrical connector fixedly operationally connected at both ends, the cable having the electrical connector at one end snapidly removedly operationally connected to the electrical connector of the first wrist strap, the cable also having the electrical connector at the other end snapidly removedly operationally connected to the electrical connector of the second wrist strap whereby electrical continuity is formed between the child and the child's guardian when the wrist straps are worn and the cable is connected whereby breaking the continuity of the cable activates the audible alarm circuitry worn by the child.

An even further object of the present invention is to provide a new and improved cable activated strayed child alarm which is susceptible of a low cost of manufacture with regard to both materials and labor, and which accordingly is then susceptible of low prices of sale to the consuming public, thereby making such cable activated strayed child alarms economically available to the buying public.

Still yet another object of the present invention is to provide a new and improved alarm system for precluding a child from straying which provides in the apparatuses and methods of the prior art some of the advantages thereof, while simultaneously overcoming some of the disadvantages normally associated therewith.

Still yet another object of the present invention is to provide a new and improved alarm system for precluding a child from straying which is versatile enough to be used for close monitoring of the child with the cable attached, such as in a shopping mall, and also to be used for locating the child without the cable, such as in a restaurant.

Yet another object of the present invention is to provide a new and improved cable activated strayed child alarm that is extremely reliable by employing cable connection between the child and the child's guardian.

Even still another object of the present invention is to provide a new and improved alarm system for precluding a child from straying which also serves as a leash to physically keep the child within a small radius of the guardian.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
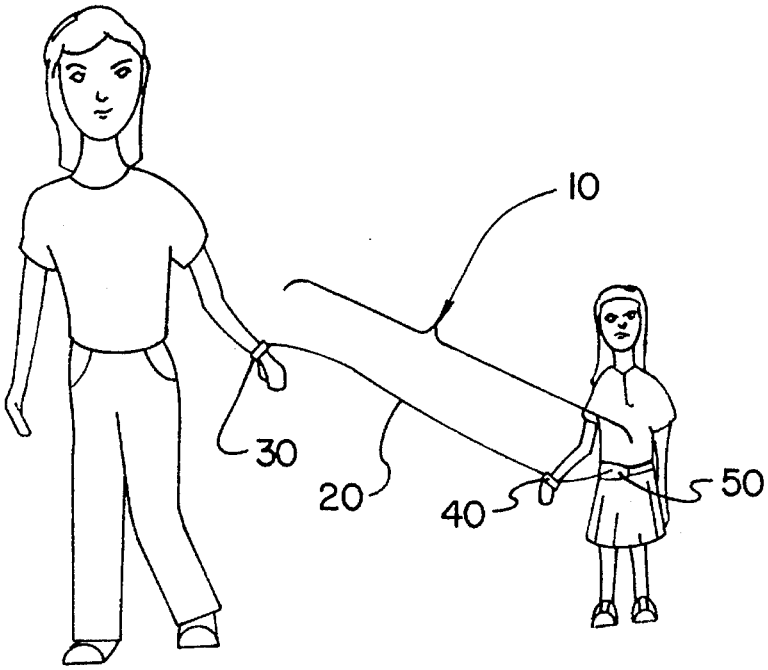
FIG. 1 is a perspective view of the invention shown in typical use by a child and the child's guardian.

With reference now to the drawings, and in particular to FIG. 1 thereof, a new and improved alarm system for precluding a child from straying embodying the principles and concepts of the present invention and generally designated by the reference numeral 10 will be described.

Figure 2:
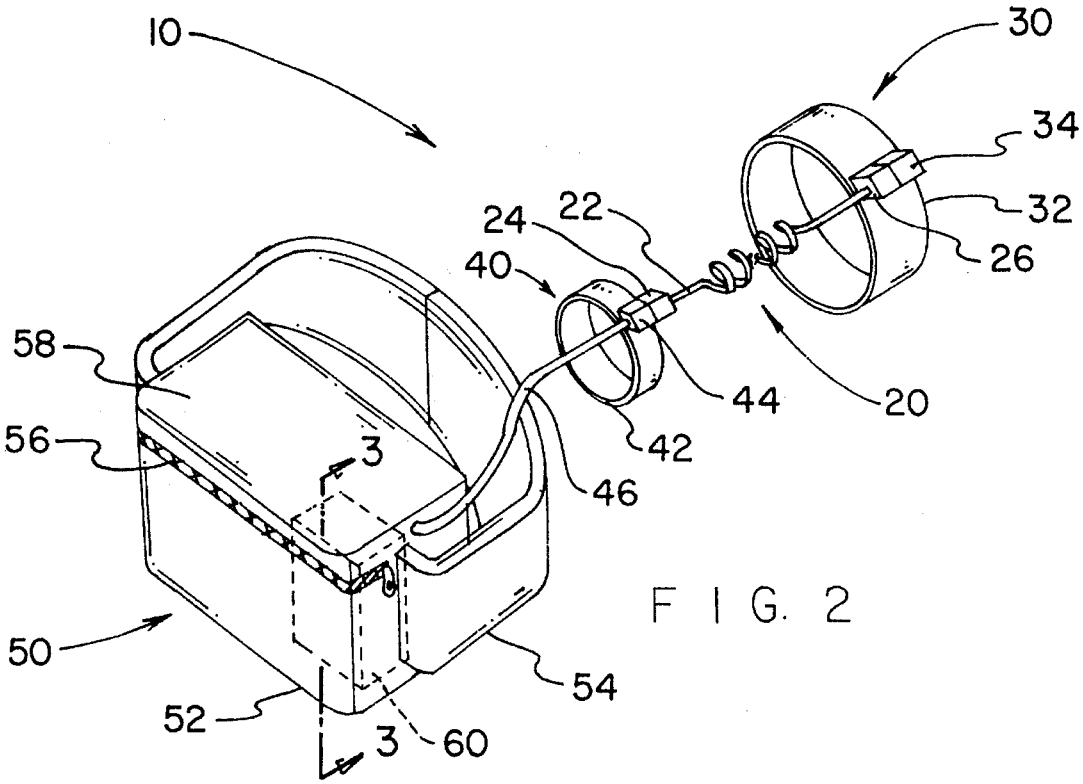
FIG. 2 is a perspective view of the invention illustrating the major component parts.
Figure 3:
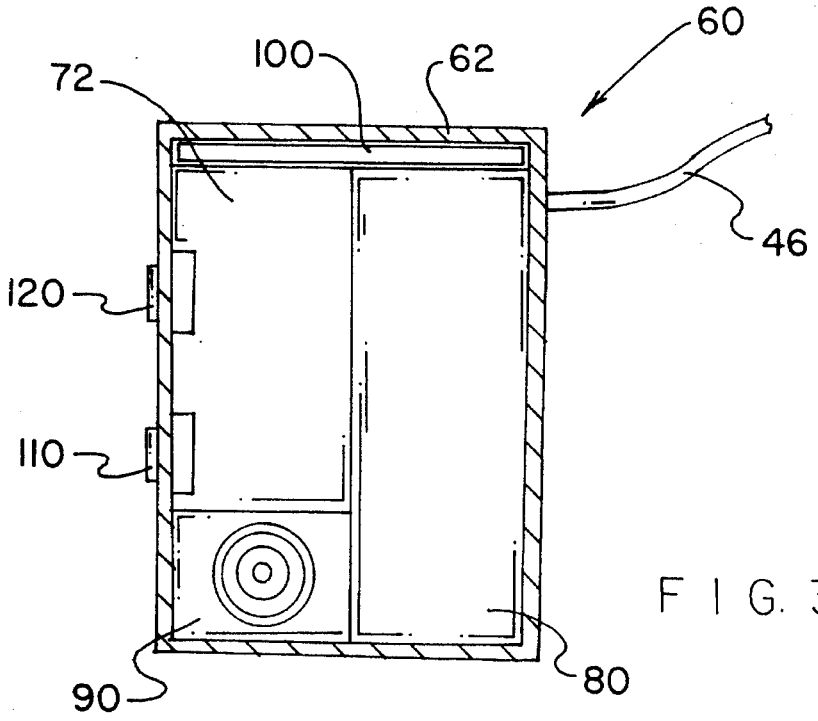
FIG. 3 is a sectional view of the electrical circuit enclosure shown in FIG. 2 taken along the line 3—3.
Figure 4:
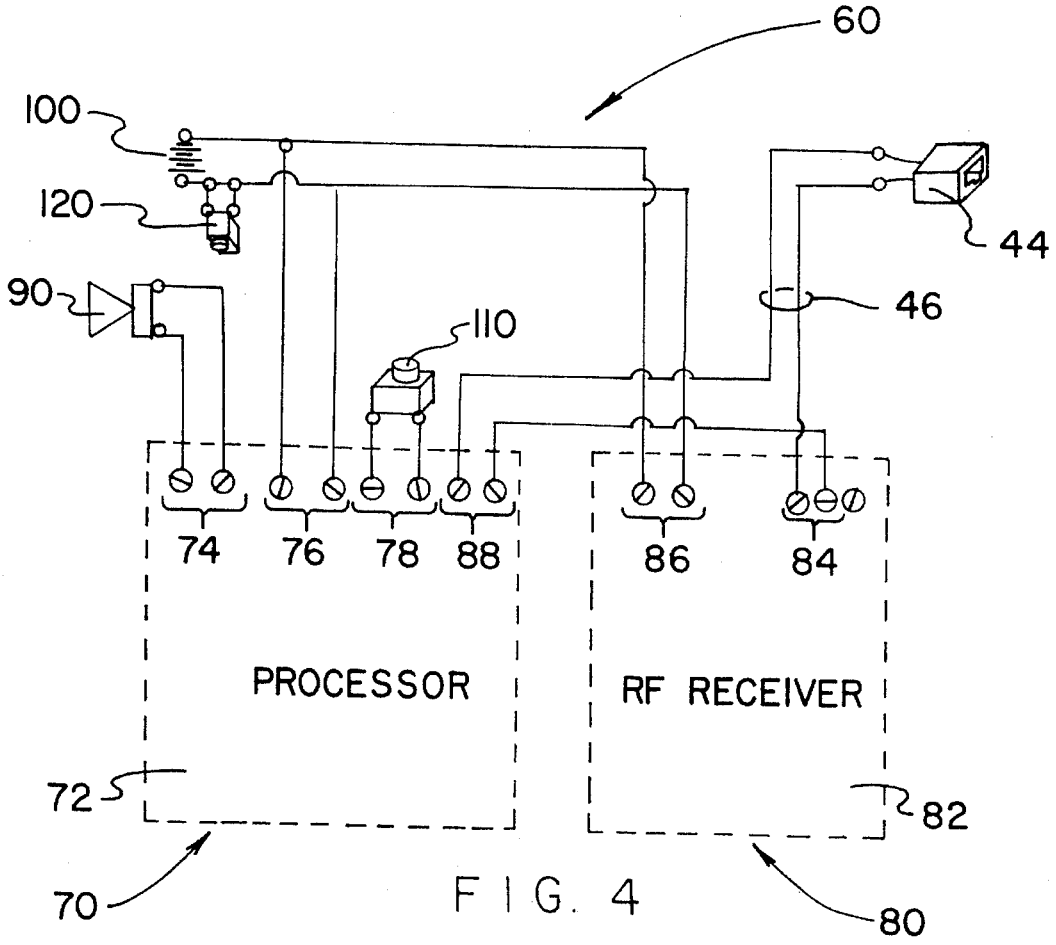
FIG. 4 is a schematic view of the radio frequency receiver means, alarm circuitry, and associated interconnect wiring of the invention.
Figure 5:
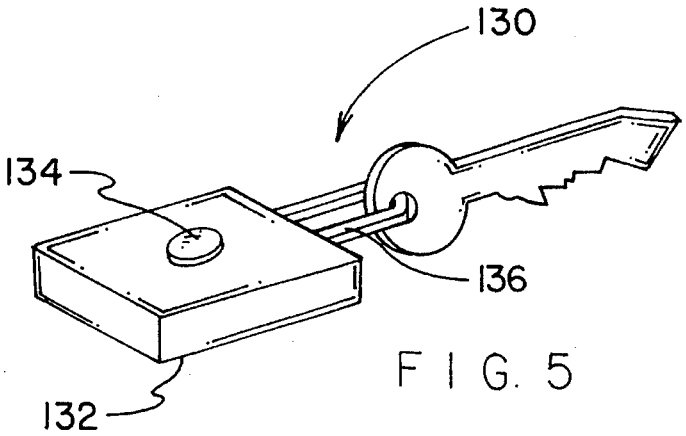
FIG. 5 is a perspective view of the radio frequency transmitter means configured as a key ring and showing the alarm actuator button.

From an overview standpoint, the alarm system for precluding a child from straying is adapted for use to automatically monitor the presence of a small child within a radius defined by the length of an cable connected between the child and the child's guardian whereby an audible alarm is activated upon disconnecting or cutting of the cable. See FIGS. 1 and 2.

With reference now to FIGS. 1 through 5, more specifically, it will be noted that the alarm system for precluding a child from straying 10 automatically monitors the presence of a small child within a radius defined by the length of an cable connected between the child and the child's guardian. An audible alarm is activated upon disconnecting or cutting of the cable 20. The cable activated strayed child alarm 10 comprises a multiconductor retractile coil cable 20 having mechanically locking multiple-contact electrical connector means 24 and 26 fixedly operationally connected to both ends, such as a standard modular telephone handset cable. The cable 20 has a first end and a second end and a predetermined length whereby a circular control zone having a radius determined by the fully extended length of the cable is defined.

The strayed child alarm 10 also includes an adult wrist strap 30 for securing the first end of the cable to the child's guardian. The adult wrist strap 30 comprises a circular band 32 of pliable elastic material, such as fabric, which has a diameter to fit comfortably snugly around an adult wrist. The circular band 32 also has a mechanically locking multiple-contact electrical connector means 34 fixedly connected thereto. The connector means 34 additionally has electrically short-circuited contacts therein and is operationally in mating relationship with the connector means 26 of the first end of the cable.

The strayed child alarm 10 additionally includes a child wrist strap 40 for securing the second end of the cable to the child. The child wrist strap 40 comprises a circular band 42 of pliable elastic material, such as fabric, and has a diameter to fit comfortably snugly around a child wrist.

The circular band 42 also has a mechanically locking multiple-contact electrical connector means 44 fixedly connected thereto and is snapidly operationally in mating relationship with the connector means 24 of the second end of the cable 20.

The cable activated strayed child alarm 10 further includes a radio frequency transmitter means 130 having a self-contained power source such as a battery (not shown). The transmitter means 130 also is of small size thereby allowing it to be used as a key ring or worn as a neck pendant.

The transmitter means 130 additionally has a ring means 136 fixedly connected thereto whereby a key or neck chain may be removedly connected and an actuator means 134 whereby a radio frequency signal transmission may be manually initiated by the user.

The strayed child alarm 10 moreover includes a radio frequency receiver means 80 having a reception frequency identical to that of the transmitter means 130 transmission frequency. The receiver means 80 also has power supply input terminals 86. The receiver means 80 additionally has normally-closed switch contact output terminals 84 which become open-circuited when a radio frequency signal from the transmitter means 130 is received.

The alarm system for precluding a child from straying 10 also has alarm means 70 for detecting an open-circuit condition produced if either of the cable connector means 24 and 26 are disconnected or if the cable 20 is severed or if a radio frequency transmission is received from the transmitter means 130 whereby an audible alarm is activated. The alarm means 70 comprises processor means circuitry 72 having power supply input terminals 76, audible signal loudspeaker output terminals 74, and normally-closed input terminals 88 which are operationally connected to the normally-closed switch contact output terminals 84 of the radio frequency receiver means 80.

The processor means 72 further has reset switch input terminals 78. The strayed child alarm 10 additionally includes a loudspeaker 90 operationally connected to the loudspeaker output terminals 74 of the processor means 72 whereby the audible alarm signal is sounded.

Further included is a self-contained power source 100, such as a battery, being operationally connected to the processor means power supply input terminals 76 and the radio frequency receiver means power supply input terminal 86. Likewise, the device has on/off means whereby power source power may be manually disconnected or reconnected to the radio frequency receiver means 80 and the processor means 72. The on/off means comprises electrical switch means 120 being operationally connected in series with the power source 100. In addition, the strayed child alarm 10 incorporates alarm reset means whereby the alarm means 70 may be reset to the ready state and the audible alarm signal may be silenced after having been activated. The alarm reset means comprises electrical switch means 110 being operationally connected to the reset switch input terminals 78 of the processor means 72.

Container means 60 is included for enclosing and shock-protecting the radio frequency receiver means 80, the processor means 72, the power source 100, and the loudspeaker 90. The container means 60 also has a user-accessible mounting surface for the on/off switch means 120 and the reset switch means 110. The container means 60 comprises a hard-shell case 62 formed of lightweight impact-resistant rigid material such as plastic. The case 62 has integral sides and bottom, and a removable top (not shown).

The case 62 additionally has a plurality of holes (not shown) therethrough wherethrough electrical cable 46 may pass and switches 110 and 120 may be mounted. The alarm system for precluding a child from straying 10 also has carry pouch means 50 whereby the container means 60 may be conveniently operationally transported by the child.

The carry pouch means 50 comprises a sack enclosure 52 formed of soft flexible resilient tear-resistant material, such as canvas, having integral sides and bottom, opposing ends, and a top flap 58 for covering the sack interior. The sack enclosure 52 additionally has closure means 56 to releasably seal the edge of the flap 58 to the sack 52, such as a zipper or hook and loop material, whereby the contents of the sack enclosure 52 will be contained within the sack regardless of sack orientation.

The carry pouch 50 further includes belt means 54 for securely comfortably releasably attaching the sack enclosure 52 to the child's waist. The belt means 54 comprises an elongated resilient band of elastic material, such as fabric, fixedly connected at each end to opposing ends of the sack. The alarm system for precluding a child from straying 10 includes a multiconductor electrical interconnect cable 46 fixedly operationally extending from the electrical connector means 44 of the child wrist strap to the normally closed terminals 84 and 88 of the radio frequency receiver means 80 and processor means 72 thereby completing the electrical closed-loop required by the alarm means 70 for proper operation.

Figure 6:
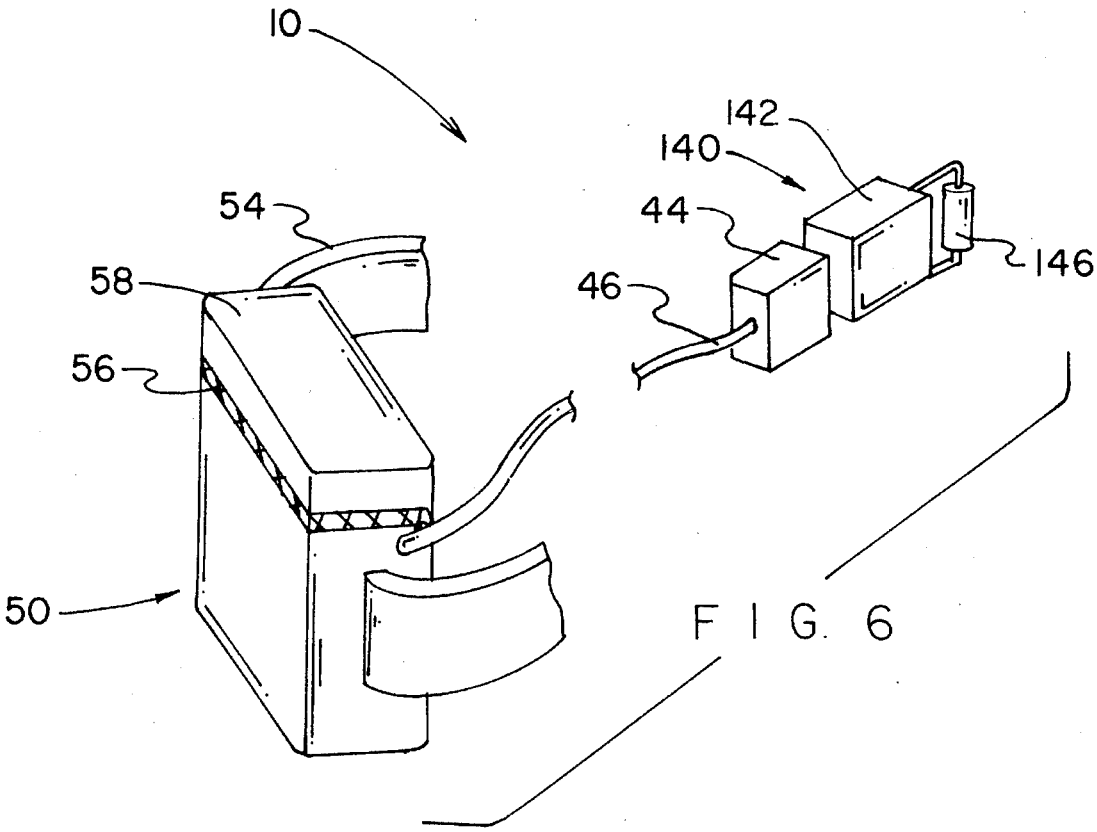
FIG. 6 is an exploded view of a first modification of the invention showing the cable bypass plug.

Referring additionally to FIG. 6, a first modification to the preferred embodiment of the alarm system for precluding a child from straying 10 is shown. The first modification further includes an umbilical cable bypass means 140 whereby the alarm may be used in radio frequency activated only mode for situations when the child's guardian does not wish to have the cable 20 extending to the child. The umbilical cable bypass means 140 comprises mechanically locking multiple-contact electrical connector means 142 having a resistor 146 therein whereby the load impedance of the cable 20 and adult wrist strap 30 is simulated. The connector means 142 is operationally snapidly connected to the child wrist strap connector means 44 in place of the cable 20.

Figure 7:
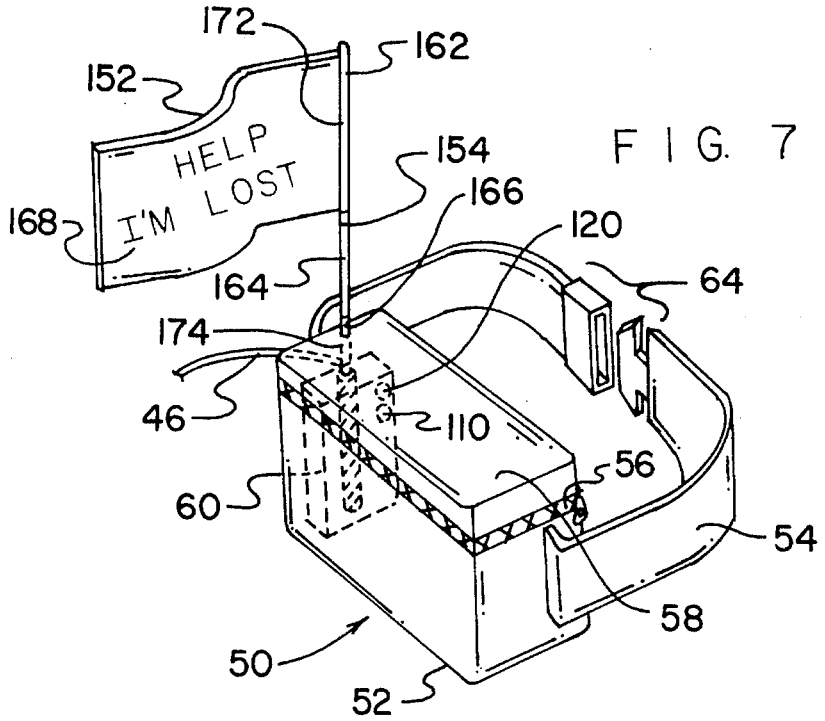
FIG. 7 is a perspective view of a second modification of the invention illustrating the visual alarm annunciator in the deployed position.
Figure 8:
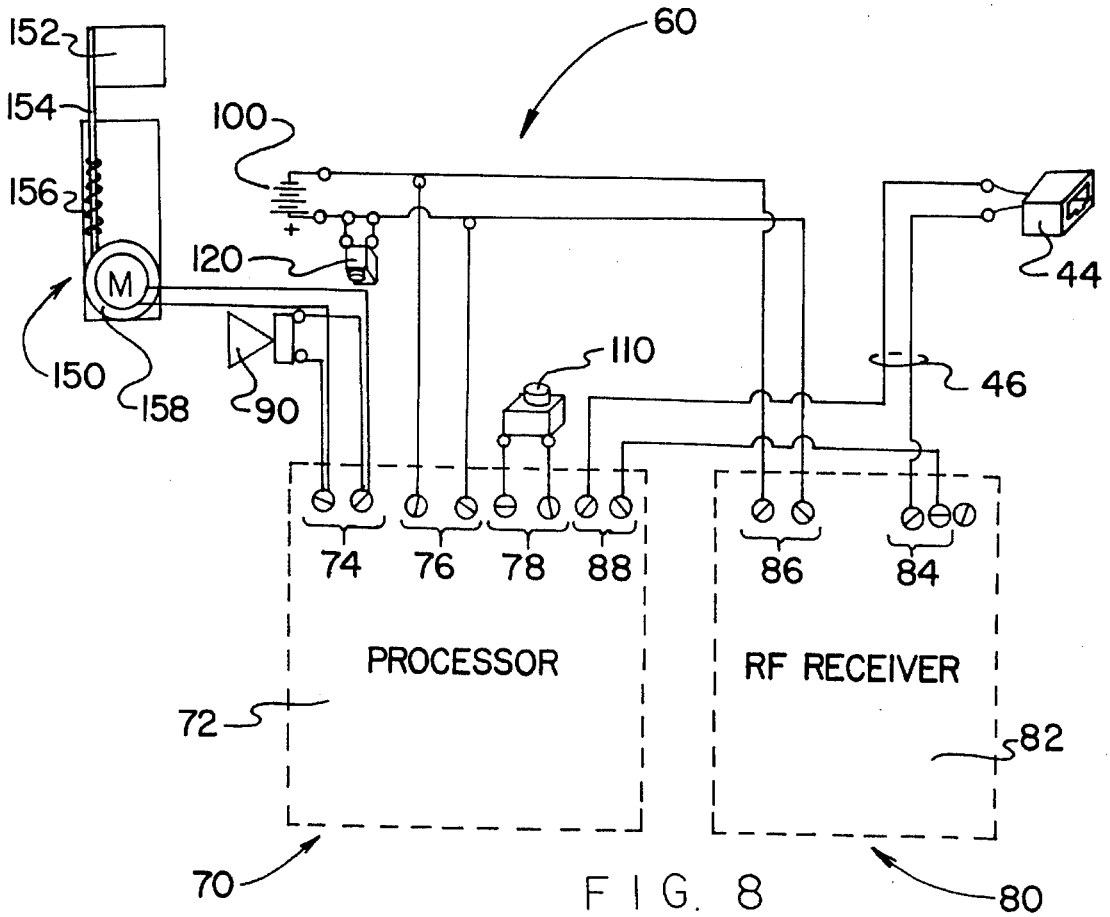
FIG. 8 is a schematic view of the invention of FIG. 7 showing the radio frequency receiver means, alarm circuitry, and associated interconnect wiring of the invention and including a visual alarm annunciator.

In a second modification of the preferred embodiment, illustrated by FIGS. 7 and 8, of the alarm system for precluding a child from straying 10, the alarm means 70 additionally includes a visual annunciator means 150 whereby a message banner 152 is deployed from the carry pouch 50 simultaneously with activation of the audible alarm. The visual annunciator means 150 comprises electrically-releasing latch means 158, such as a solenoid, the latch means being operationally connected to the loudspeaker output terminals 74 of the processor means 72 whereby the latch 158 is released whenever an alarm signal is generated by the processor means 72.

The visual annunciator 150 additionally includes a hollow shaft 154 fixedly connected at the bottom end to the inside of the container means 60 and projecting outwardly and upwardly from inside the container means to a short distance above and outside the container means. The shaft 154 has a plurality of telescoping sections 162, 164, and 166 whereby complete retraction inside the container means 60 is possible. The shaft 154 also has biasing means 156, such as a coil compression spring, disposed inside the hollow portion whereby the shaft 154 may be springedly deployed to a fully extended erect position.

The shaft 154 is releasably held in the retracted position by the electrically-releasing latch means 158. The visual annunciator 150 further includes banner means 152 whereby a distress message such as "HELP I'M LOST" may be prewritten thereon whereby the child may be easily recognized as a stray by surrounding people. The banner means 152 comprises a thin planar sheet 168 of material such as plastic. The sheet 168 is rectangular in shape with the small dimension not larger than the length of the top most shaft telescoping section 162. The sheet 168 also has stiffness to stand fully outstretched when suspended vertically by one of the short edges 172 and flexibility to be rolled into a tight cylinder for furling.

The sheet 168 is fixedly longitudinally connected along one of the short edges 172 to the top most telescoping section 162 of the shaft and is rolled into a tight cylinder around the top shaft section thereby being held furled by the inside confines of the container ready for deployment when the latch means 158 receives an alarm signal from the alarm means 70 whereby releasing the telescoping shaft 154 to spring upward whereby allowing the furled coiled banner 152 to uncoil to display the distress message. The second modification to the alarm system for precluding a child from straying 10 moreover includes a hole 174 through the top of the sack enclosure adjacent to the telescoping shaft 154 wherethrough the shaft may extend upon erection.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. An alarm system for precluding a child from straying that automatically monitors the presence of a small child within a radius defined by the length of a cable connected between a child and a guardian of the child whereby an audible alarm is activated upon disconnecting or cutting of the cable, the alarm system comprising:

a multiconductor retractable coiled cable having a first end and a second end and with each end having a separate mechanically locking multiple-contact electrical connector means fixedly operationally connected thereto, the cable further having a predetermined length whereby a circular control zone having a radius determined by the fully extended length of the cable is defined;

an adult wrist strap for securing the first end of the cable to a guardian of the child, the adult wrist strap including a circular band of pliable elastic material, the circular band comfortably snugly securable around the guardian's wrist, the circular band also including a mechanically locking multiple-contact electrical connector means fixedly connected thereto, the connector means of the adult wrist strap additionally having electrically short-circuited contacts therein, the connector means of the adult wrist strap being operationally mated with the connector means of the first end of the cable;

a child wrist strap for securing the second end of the cable to the child, the child wrist strap including a circular band of pliable elastic material, the circular band comfortably snugly securable about the child's wrist, the circular band also including a mechanically locking multiple-contact electrical connector means fixedly connected thereto, the connector means of the child wrist strap being operationally mated with the connector means of the second end of the cable;

radio frequency transmitter means having a self-contained power source, the transmitter means also having small dimensions and a shape for allowing it to be secured to a key ring or worn as a neck pendant, the transmitter means further having an actuator means for manually initiating a radio frequency signal transmission at a characteristic transmission frequency;

radio frequency receiver means having a reception frequency identical to the characteristic transmission frequency of the transmitter means, the receiver means also having power supply input terminals, the receiver means additionally having normally-closed switch contact output terminals which become open-circuited when a radio frequency signal from the transmitter means is received;

alarm means for detecting an open-circuited condition whereby an audible alarm is activated, the alarm means further comprising processor means circuitry having power supply input terminals, the processor means circuitry also having audible signal loudspeaker output terminals, the processor means circuitry additionally having normally-closed input terminals operationally connected to the normally-closed switch contact output terminals of the radio frequency receiver means, the processor means circuitry further having reset switch input terminals;

a loudspeaker operationally connected to the loudspeaker output terminals of the processor means circuitry for allowing an audible alarm signal to be sounded;

a self-contained power source, the power source being operationally connected to the processor means circuitry power supply input terminals, the power source also being operationally connected to the radio frequency receiver means power supply input terminals;

on/off means for manually disconnecting and reconnecting the power source to the radio frequency receiver means and the processor means circuitry, the on/off means including electrical switch means being operationally connected in series with the power source;

alarm reset means for allowing the alarm means to be reset and for silencing the audible alarm signal, the alarm reset means including electrical switch means being operationally connected to the reset switch input terminals of the processor means circuitry;

container means for enclosing and shock-protecting the radio frequency receiver means, the processor means circuitry, the power source, and the loudspeaker, the container means also having a user-accessible mounting surface for holding the on/off means and the reset means, the container means including a hard-shell case formed of lightweight impact-resistant rigid material, the case having integral sides and bottom, the case also having a removable top, the case additionally having a plurality of holes formed thereon for allowing passage of electrical cables therethrough and mounting of electrical switch means therein;

carry pouch means for allowing the container means to be conveniently operationally transported by the child, the carry pouch means further comprising a sack enclosure formed of soft flexible resilient tear-resistant material having integral sides and a bottom with the sides and bottom bounding a hollow interior, the sack enclosure having opposing ends, the sack enclosure also having a top flap for covering the interior, the sack enclosure additionally having a closure means to releasably seal the flap;

belt means for securably comfortably releasably attaching the sack enclosure to a child's waist, the belt means including an elongated resilient band of elastic material fixedly connected at each end to opposing ends of the sack enclosure; and a multiconductor electrical interconnect cable fixedly operationally extending from the electrical connector means of the child wrist strap to the normally closed terminals of the radio frequency receiver means and processor means circuitry thereby completing the closed-loop required by the alarm means for proper operation.

2. The alarm system for precluding a child from straying as set forth in claim 1 and further including a cable bypass means for allowing the alarm system to be used in radio frequency activated only mode for situations when a guardian of a child does not wish to have the cable extending to the child, the cable bypass means comprising:

mechanically locking multiple-contact electrical connector means having a resistor therein whereby the load impedance of the cable and adult wrist strap is simulated, the connector means being operationally connected to the child wrist strap connector means in place of the cable.

3. The alarm system for precluding a child from straying as set forth in claim 1 wherein the alarm means additionally includes a visual annunciator means whereby a message banner is deployed from the carry pouch means simultaneously with activation of the audible alarm, the visual annunciator means comprising:

electrically-releasing latch means, the latch means being operationally connected to the loudspeaker output terminals of the processor means circuitry whereby the latch means is released whenever an alarm signal is generated by the processor means circuitry;

a hollow elongated shaft having one end fixedly connected inside of the container means and another end projecting outwardly and upwardly from inside the container means to a short distance above and outside the container means, the shaft formed of a plurality of telescoping sections for allowing its complete retraction inside the container means, the shaft having biased means disposed inside the container means for allowing it to be deployed to a fully extended erect position, the shaft being releasably held in a retracted position by the latch means; and banner means bearing a distress message thereon for allowing the child to be easily recognized as a stray by surrounding people, the banner means further comprising a thin planar sheet of material, the sheet being rectangular in shape with a periphery formed of a pair of opposed short edges interconnected with a pair of long edges, the short edges of the sheet each having a small dimension not larger than the length of the top-most telescoping section of the shaft and with one of the short edges being fixedly coupled to the top-most telescoping section of the shaft, the sheet having sufficient stiffness to be fully outstretched in one position when suspended vertically by the top-most telescoping section of the shaft and further having sufficient flexibility to be furled into a tight cylinder in another position, the sheet further being furled around the top-most telescoping section of the shaft and disposed within the container means in a position ready for deployment when the latch means allows the shaft to spring upward upon receipt of an alarm signal from the alarm means, thereby allowing the furled sheet to unfurl and display the distress message; and a hole through the top of the sack enclosure adjacent to the shaft wherethrough the shaft is extended upon erection.

4. An alarm system for precluding a child from straying that automatically monitors the presence of a small child within a radius defined by the length of a cable connected between the child and a guardian of the child whereby an audible alarm is activated upon disconnecting or cutting of the cable, the alarm system comprising:

a backpack or waistpack worn by the child, the pack containing electrical circuitry for allowing an audible alarm to be sounded when the electrical circuitry is activated;

a first wrist strap worn by a child, the first wrist strap having electrical connector means fixedly connected thereto;

an electrical interconnect cable fixedly operationally connected to the first wrist strap connector means, the interconnect cable extending from the first wrist strap to the electrical circuitry inside the pack, the interconnect cable being operationally connected to the electrical circuitry;

a second wrist strap worn by a guardian, the second wrist strap having electrical connector means fixedly connected thereto, the electrical connector means of the second wrist strap operationally connected together whereby a short-circuit is formed; and a retractable electrical cable having electrical connector means fixedly operationally connected at both ends, the cable having the electrical connector means at one end removedly operationally connected to the electrical connector means of the first wrist strap, the cable also having the electrical connector means at the other end removedly operationally connected to the electrical connector means of the second wrist strap whereby electrical continuity is formed between a child and a guardian of the child when the wrist straps are worn and the cable is connected and whereby breaking the continuity of the cable activates the electrical circuitry for sounding the audible alarm.

* * * * *